US009926835B2

(12) United States Patent
Han et al.

(10) Patent No.: US 9,926,835 B2
(45) Date of Patent: Mar. 27, 2018

(54) COOLING SYSTEM AND CONTROL METHOD OF VEHICLE

(71) Applicant: Hyundai Motor Company, Seoul (KR)

(72) Inventors: Su Dong Han, Gyeonggi-do (KR); Hyung Kook Kim, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 36 days.

(21) Appl. No.: 15/255,701

(22) Filed: Sep. 2, 2016

(65) Prior Publication Data

US 2017/0342892 A1 Nov. 30, 2017

(30) Foreign Application Priority Data

May 24, 2016 (KR) ..... 10-2016-0063275

(51) Int. Cl.

| | |
|---|---|
| ***B60H 1/00*** | (2006.01) |
| ***F01P 11/02*** | (2006.01) |
| ***F01P 11/14*** | (2006.01) |

(52) U.S. Cl.

CPC ..... *F01P 11/0285* (2013.01); *F01P 11/14* (2013.01); *F01P 2025/04* (2013.01); *F01P 2025/08* (2013.01)

(58) Field of Classification Search

CPC .... F01P 11/0285; F01P 11/14; F01P 2025/04; F01P 2025/08

USPC ..... 165/11.1

See application file for complete search history.

(56) References Cited

U.S. PATENT DOCUMENTS

| | | | | | |
|---|---|---|---|---|---|
| 3,499,481 | A * | 3/1970 | Avrea | F01P 11/0238 | 123/41.15 |
| 3,601,181 | A * | 8/1971 | Avrea | F01P 11/02 | 123/41.21 |
| 4,102,178 | A * | 7/1978 | Mercik, Jr. | F01P 11/0214 | 73/49.7 |
| 4,196,822 | A * | 4/1980 | Avrea | F01P 11/0238 | 220/203.06 |
| 4,300,718 | A * | 11/1981 | Beyer | F01P 11/0285 | 123/41.09 |
| 4,862,731 | A * | 9/1989 | Gates | G01M 3/226 | 73/40.7 |
| 2007/0034702 | A1* | 2/2007 | Rixen | B60H 1/2206 | 237/2 A |

FOREIGN PATENT DOCUMENTS

| | | | |
|---|---|---|---|
| JP | 2005-166497 | A | 6/2005 |
| JP | 2006-140005 | A | 6/2006 |
| JP | 2008-210705 | A | 9/2008 |
| JP | 2010-009855 | A | 1/2010 |
| JP | 2011-216341 | A | 10/2011 |
| JP | 2012-215141 | A | 11/2012 |
| KR | 20-1997-0062832 | U | 12/1997 |
| KR | 2013-0124789 | A | 11/2013 |

* cited by examiner

*Primary Examiner* — Justin Jonaitis

(74) *Attorney, Agent, or Firm* — Mintz Levin Cohn Ferris Glovsky and Popeo, P.C.; Peter F. Corless

(57) ABSTRACT

A cooling system for a vehicle is provided. The system includes a valve that is disposed at a predetermined position in a cooling channel to discharge bubbles produced in a coolant out of the cooling channel. Additionally, a controller is configured to detect whether bubbles have been produced in the coolant using a rate of pressure change based on a temperature increase in the cooling channel and open the valve in response to detecting that bubbles have been produced.

10 Claims, 4 Drawing Sheets

Rate of pressure change according to temperature increase in cooling channel when bubbles have not been produced in coolant Rate of pressure change according to temperature increase in cooling channel when bubbles have been produced in coolant Rate of pressure change according to temperature increase in cooling channel when bubbles have not been produced in coolant Rate of pressure change according to temperature increase in cooling channel when bubbles have been produced in coolant Valve open Valve closed

COOLING SYSTEM AND CONTROL METHOD OF VEHICLE

CROSS REFERENCE TO RELATED APPLICATION

The present application claims priority to Korean Patent Application No. 10-2016-0063275, filed May 24, 2016, the entire contents of which are incorporated herein for all purposes by this reference.

BACKGROUND

Field of the Invention

The present invention relates to a cooling system, and more particularly, to a cooling system that discharges bubbles by opening a valve when bubbles are produced, and a method of controlling the cooling system.

Description of the Related Art

In general, while vehicles is being operated, the temperature inside the engine combustion chambers increases to over about 150° C., and the temperature is not appropriately reduced, thus causing damage to various components of the engine body, a reduction in viscosity and deterioration of a lubricant, a reduction in intake efficiency due to expansion of a gas mixture, and abnormal combustion and overheating of the engine, leading to poor operation and consequently potential malfunction of the engine.

Accordingly, engines are equipped with a cooling system for maintaining the temperatures of combustion chambers, cylinders, and valve assemblies at optimum levels for engine operation. Cooling systems are generally classified into an air cooing type that cools an engine at a high temperature by suctioning and blowing external air around the engine and a water cooling type that cools an engine at a high temperature by circulating a coolant around combustion chambers of the engine. The air cooling type is generally used for two-wheeled vehicles such as a motorcycle due to the relatively low cooling performance, while the water cooling type is generally used for vehicles.

Among these cooling systems, water cooling systems may be classified into a natural circulation type and a forced circulation type based on the water circulation. The forced circulation type, which is a representative type for vehicle engines, cools an engine by forcibly circulating a coolant using a water pump, and includes a radiator, a water pump, a water jacket, and a thermostat. The basic structure of cooling systems described above is also used for environmentally friendly vehicles such as hybrid vehicles and fuel cell vehicles. The related has proposed a device and method that may accurately and rapidly sense a deficiency of a coolant in a fuel cell vehicle using a signal from a pressure sensor in a cooling system for a fuel cell vehicle. However, the proposed device and method fail to provide a technique for removing bubbles in the cooling system.

The description provided above as a related art of the present invention is just for helping understanding the background of the present invention and should not be construed as being included in the related art known by those skilled in the art.

SUMMARY

Accordingly, the present invention provides a cooling system for a vehicle that may determine whether bubbles have been produced in a cooling channel using a rate of pressure change based on a temperature increase in the cooling channel and may discharge bubbles by opening a valve when bubbles have been produced.

According to one aspect of the present invention, a cooling system for a vehicle may include: a valve disposed at a predetermined position within a cooling channel to discharge bubbles produced in a coolant from the cooling channel; and a controller configured to detect the production or generation of bubbles in the coolant using a rate of pressure change based on a temperature increase in the cooling channel, and open the valve in response to detecting the bubbles.

The controller may further be configured to detect the generation of bubbles in the coolant when the rate of pressure change is a predetermined reference value or less. The controller may then be configured to close the valve when a rate of pressure change based on a temperature increase after the valve is opened exceeds the reference value. The controller may be configured to open the valve for a predetermined opening time in response to detecting the bubble generation, and the opening time may be in inverse proportion to the rate of pressure change.

According to another aspect of the present invention, a method of controlling the cooling system for a vehicle may include: determining a rate of pressure change based on a temperature increase in a cooling channel by a controller; detecting whether bubbles have been produced in a coolant by the controller using the rate of pressure change; and discharging bubbles by opening a valve at a predetermined position in the cooling channel by the controller in response to detecting the bubble generation.

The method may further include increasing a temperature in the cooling channel by operating a heater using the controller before determining the rate of pressure change. The bubble generation may be detected when the rate of pressure change is a predetermined value or less. The method may further include: after discharging of the bubbles, obtaining a rate of pressure change based on a temperature increase after the valve is opened by the controller; and closing the valve by the controller when the rate of pressure change exceeds a predetermined reference value after the valve is opened. Additionally, the method may include, after discharging of the bubbles, closing the valve by the controller when time that has been lapsed after the valve is opened exceeds a predetermined opening time. The opening time may be in inverse proportion to the rate of pressure change.

According to the preset invention, it may be possible to determine whether bubbles have been produced in a coolant without a specific sensor. Further, it may be possible to open a valve based on bubble generation and also to prevent deterioration of cooling performance of a vehicle due to the discharge of bubbles for a substantial period of time by closing the valve in response to determining that bubbles have been removed to a predetermined level.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referral to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 2:
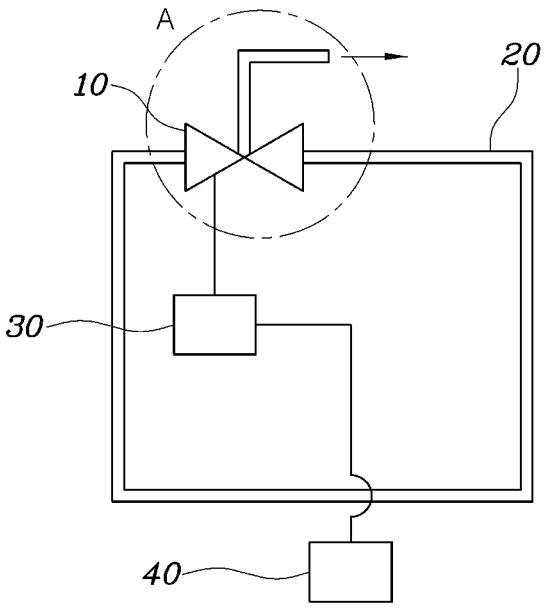
FIG. 2 is a diagram showing the configuration of a cooling system for a vehicle according to an exemplary embodiment of the present invention.

Hereinafter, exemplary embodiments of the present invention will be described in detail with reference to the accompanying drawings. A cooling system for a vehicle according to the present invention, as shown in FIG. 2, may include: a valve 10 disposed at a predetermined position in a cooling channel 20 to discharge bubbles generated or produced in a coolant out of the cooling channel 20; and a controller 30 configured to detect the generation of bubbles in the coolant using a rate of pressure change based on a temperature increase in the cooling channel 20 and open the valve 10 in response to detecting the bubble generation.

Figure 1A:
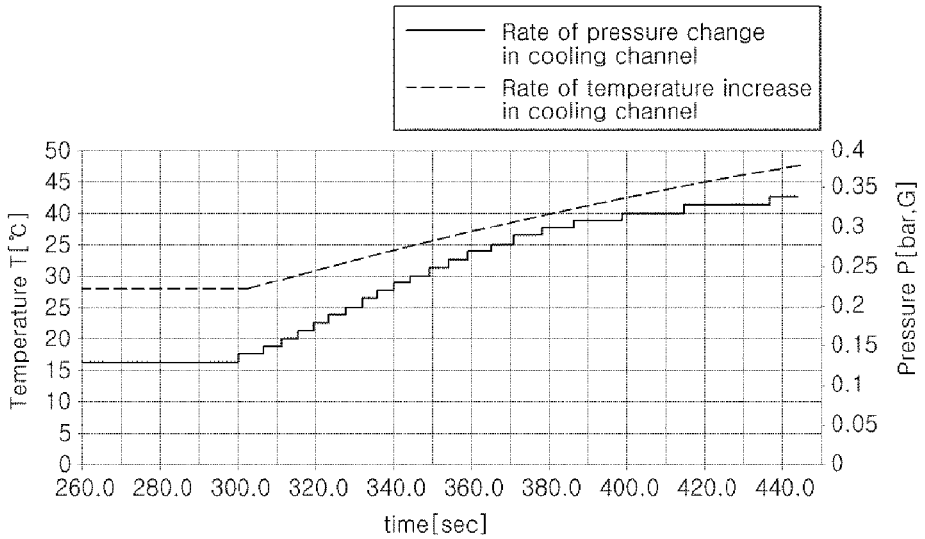
FIGS. 1A and 1B are graphs comparing rates of pressure change according to a temperature increase in a cooling channel when bubbles are produced and not produced in a coolant according to an exemplary embodiment of the present invention.
Figure 1B:
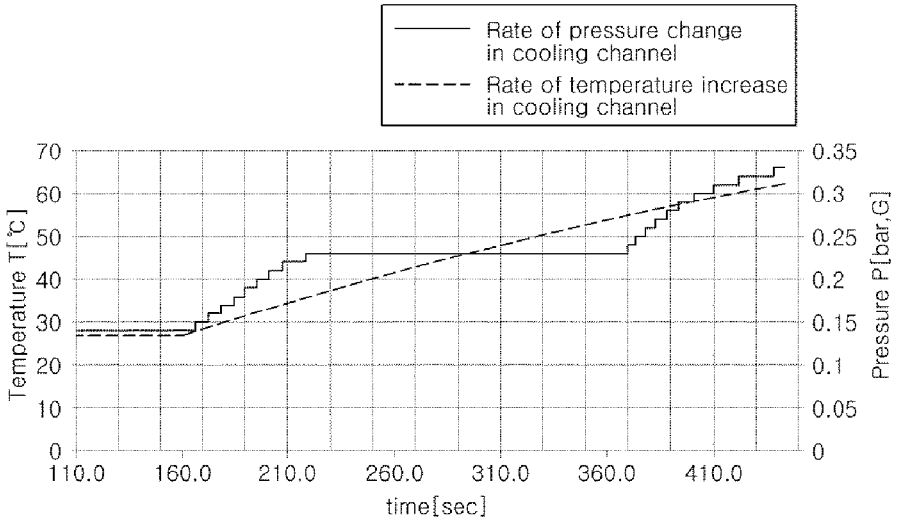

The present invention proposes a rate of pressure change based on a temperature increase in the cooling channel 20 as a standard for determining whether bubbles have been produced in a coolant, and the reason may be seen from the graphs of FIGS. 1A and 1B comparing rates of pressure change when bubbles have been produced and not produced. FIG. 1A is a graph showing a rate of pressure change based on a temperature increase in the cooling channel 20 when bubbles have not been produced in a coolant and FIG. 1B is a graph showing a rate of pressure change based on a temperature increase in the cooling channel 20 when bubbles have been produced in a coolant. The solid line graphs show rates of pressure change and the dotted line graphs show rates of temperature increase.

The graph shown in FIG. 1A shows that as the temperature in the cooling channel 20 increases, the rate of pressure change in the cooling channel 20 may increase almost proportionally. The pressure increase may be caused by various factors, including the characteristic that the volume increases with an increase in temperature. However, when there are bubbles in the coolant, even when the volume of the coolant increases due to an increase in temperature, the increase in volume occupies the empty spaces generated by the bubbles in the coolant, and thus, the amount of increase in volume of the coolant is less than when bubbles are not distributed throughout the coolant. Accordingly, the rate of pressure change based on a temperature increase in the cooling channel 20 is less when there are bubbles in the coolant than when there are no bubbles, which is shown in FIG. 1B. The graph in FIG. 1B shows that the temperature in the cooling channel 20 continuously increases, but the pressure in the cooling channel 20 may be maintained without increase for a predetermined period.

Figure 3:
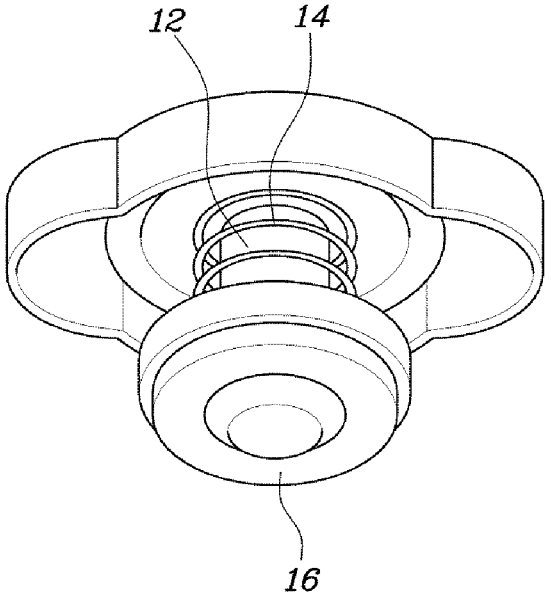
FIG. 3 is a diagram showing a valve according to an exemplary embodiment of the present invention.

Therefore, the present invention, in consideration of this phenomenon, may determine whether bubbles have been produced in a coolant, discharge bubbles by opening the valve 10 in the cooling channel 20 when bubbles have been generated in the coolant, and close the valve 10 when the bubbles have been discharged to more smoothly circulate the coolant through the cooling channel 20. The valve 10 in the system of the present invention may be any of various types of valves including electronic valves or mechanical valves and FIG. 3 shows an electronic valve 10 by way of example. In particular, the electronic valve 10 according to the present invention may have a pressing-cap seat 16 that may close an outlet for discharging bubbles from the cooling channel 20, an electronic valve actuator 12 coupled to the pressing-cap seat 16 to open or close the valve, and a positive pressure spring 14 that may compress and expand based on the pressure in the cooling channel 20.

Figure 4A:
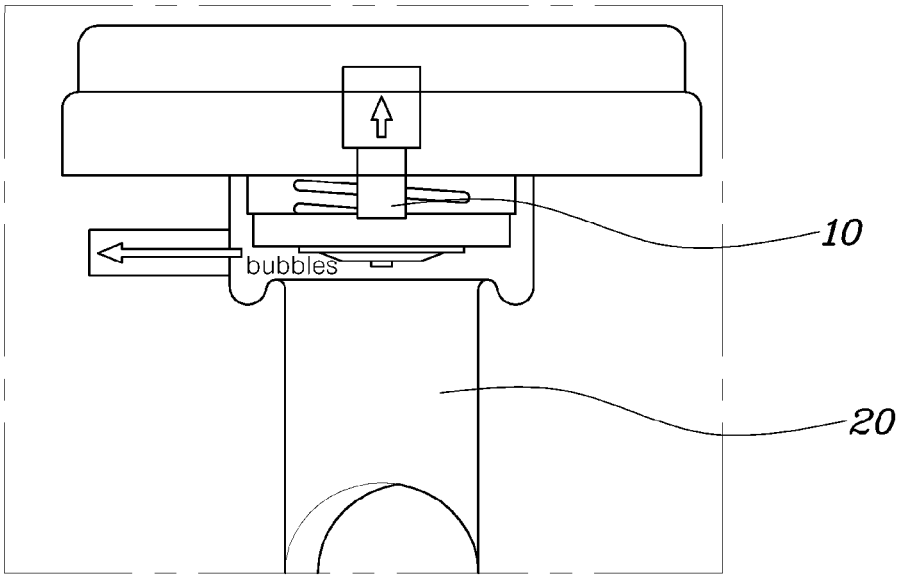
FIGS. 4A and 4B are diagrams showing the system when the valve is opened and closed in accordance with an exemplary embodiment of the present invention.
Figure 4B:
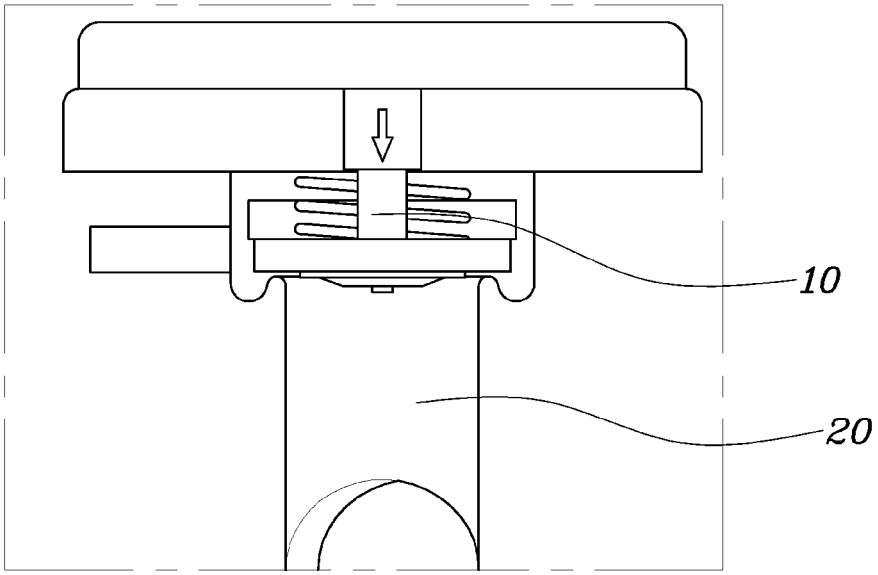

FIGS. 4A and 4B show a cooling system for a vehicle equipped with the valve 10 when the valve 10 is opened and closed. FIG. 4A shows the valve 10 opening, in which the electronic valve actuator 12 may be configured to move the pressing-cap seat 16 to discharge bubbles through a bubble exit (e.g., a bubble discharge or outlet). Further, when bubbles are not present in a coolant, as shown in FIG. 4B, the electronic valve actuator 12 may be configured to move the pressing-cap seat 16 in contact with the cooling channel.

Particularly, when the rate of pressure change based on a temperature increase in the cooling channel 20 is a predetermined level or less, the controller 30 may be configured to determine that bubbles have been produced in the coolant. The rate of pressure change and the reference value are values obtained by dividing the amount of pressure change attributable to a temperature increase in the cooling channel 20 by the amount of temperature change. The rate of pressure change may be obtained by dividing the amount of pressure change for a predetermined time (e.g., the time for which the designer maintains a temperature increase in the cooling channel 20) by the amount of temperature change and the reference value may be a rate of pressure change when bubbles have been produced and may be variously set based on the type of coolant and the requirements of the designer.

For example, when a designer increases the temperature in the cooling channel 20 by about 10° C. to determine whether bubbles have been produced in a coolant and the amount of pressure change during the period in which the temperature in the cooling channel 20 is increased is about 0.005 bar, the rate of pressure change may be about 0.005 bar/° C. Further, when the reference value set in accordance with the characteristics of the coolant and the requirements of the designer is about 0.007 bar/° C., the rate of pressure change may be less than the reference value, and thus, the controller 30 may be configured to determine the generation of the bubbles in the coolant. Accordingly, as proposed in the present invention, the controller 30 may be configured to open the valve 10 to discharge the bubbles produced in the coolant.

When the valve 10 remains open once opened to discharge the bubbles, the coolant may be unable to smoothly circulate through the cooling channel 20, and thus, the cooling performance of the vehicle may deteriorate. Accordingly, the valve may be closed to maintain the cooling performance of the vehicle after discharging the bubbles produced in the coolant, in which the rate of pressure change may be used as the determination reference for closing the valve 10, as described above. In other words, when the rate of pressure change based on a temperature increase exceeds the reference value after the valve 10 is opened, the controller 30 may be configured to close the valve 10. For example, similarly as described above, when the temperature in the cooling channel 20 is increased by about 10/° C. after the valve 10 is opened and the rate of pressure change in the cooling channel during the period in which the temperature is increased is about 0.1 bar, the rate of pressure change may be about 0.01 bar/° C., which is greater than the reference value of about 0.007 bar/° C., and thus, it may be possible to determine that there are no bubbles in the coolant, and accordingly, the controller 30 may be configured to close the valve 10.

Accordingly, it may be possible to appropriately discharge bubbles produced in a coolant out of the cooling channel 20 by controlling the valve 10 as described above. However, the temperature in the cooling channel 20 may be continuously increased to determine whether bubbles have been produced, and thus, energy may be consumed to increase the temperature, which may be disadvantageous in terms of energy efficiency. Therefore, the present invention proposes a method of opening the valve 10 for a predetermined opening time when determining that bubbles have been produced to prevent the above described issues.

According to this method, the temperature in the cooling channel 20 is not required to be increased to obtain the rate of pressure change based on a temperature increase that is the reference for closing the valve 10, and thus, it may be possible to slightly reduce energy consumption for increasing the temperature in the cooling channel 20. The opening time may depend on the type of coolant and requirements of the designer, but it may be advantageous for the opening time to be in inverse proportion to the rate of pressure change obtained for opening the valve 10 before the controller 30 opens the valve 10. Accordingly, it may be possible to determine that the greater the rate of pressure change, the more bubbles produced in the coolant, and thus, it may be possible to sufficiently discharge bubbles out of the cooling channel 20 when the opening time is substantial.

Figure 5:
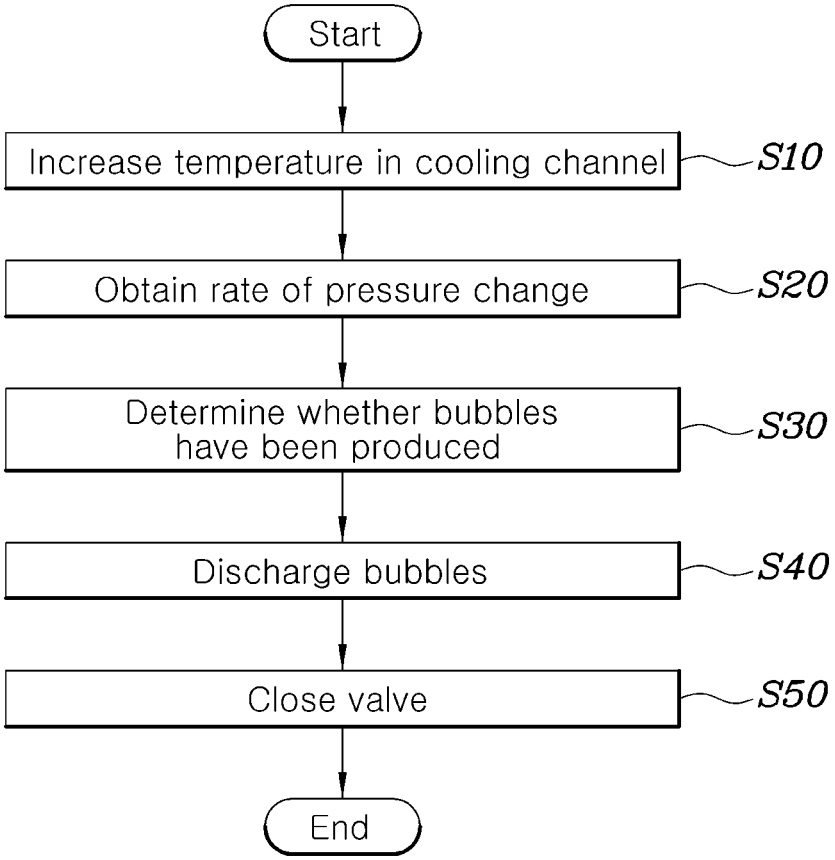
FIG. 5 is a flowchart illustrating a method of controlling a cooling system for a vehicle according to an exemplary embodiment of the present invention.

Meanwhile, a method of controlling a cooling system for a vehicle according to the present invention, as shown in FIG. 5, may include: increasing the temperature in a cooling channel by operating a heater 40 using the controller 30 (S10); obtaining a rate of pressure change based on a temperature increase in the cooling channel by the controller 30 (S20); determining whether bubbles have been produced in the coolant using the rate of pressure change by the controller 30 (S30); discharging bubbles by opening the valve 10 at a predetermined position in the cooling channel 20 by the controller 30 in response to determining that bubbles have been produced (S40); and closing the valve by the controller 30 when the rate of pressure change exceeds a predetermined reference value after the valve 10 is opened or when the time that has lapsed after the valve 10 is opened exceeds a predetermined opening time (S50).

Further, the rate of pressure change after the valve 10 is opened may be compared with the predetermined reference value and the controller 30 may be configured to close the valve 10 (S50), to determine the rate of pressure change again after the valve 10 is opened in the discharging of bubbles (S40), and thus, the rate of pressure change based on a temperature increase in the cooling channel 20 may be determined by increasing the temperature in the cooling channel 20 again, as described above.

Although the present invention was described with reference to specific exemplary embodiments shown in the drawings, it is apparent to those skilled in the art that the present invention may be changed and modified in various ways without departing from the scope of the present invention, which is described in the following claims.

What is claimed is:

1. A cooling system for a vehicle, comprising:

a valve disposed at a predetermined position in a cooling channel to discharge bubbles produced in a coolant out of the cooling channel; and a controller configured to detect whether bubbles have been produced in the coolant using a rate of pressure change based on a temperature increase in the cooling channel, and open the valve in response to detecting that the bubbles have been produced.

2. The system of claim 1, wherein the controller is configured to detect that the bubbles have been produced in the coolant when the rate of pressure change is a predetermined reference value or less.

3. The system of claim 2, wherein the controller is configured to close the valve when a rate of pressure change based on a temperature increase after the valve is opened exceeds the predetermined reference value.

4. The system of claim 1, wherein the controller is configured to open the valve for a predetermined opening time when in response to determining that the bubbles have been produced, and the opening time is in inverse proportion to the rate of pressure change.

5. A method of controlling the cooling system for a vehicle, comprising:

obtaining, by a controller, a rate of pressure change based on a temperature increase in a cooling channel;

detecting, by the controller, whether bubbles have been produced in a coolant using the rate of pressure change; and discharging, by the controller, the bubbles by opening a valve at a predetermined position in the cooling channel in response to detecting that the bubbles have been produced.

6. The method of claim 5, further comprising:

increasing, by the controller, a temperature in the cooling channel by operating a heater before the obtaining of the rate of pressure change.

7. The method of claim 5, wherein the detecting of whether the bubbles have been produced includes detecting that the bubbles have been produced in the coolant when the rate of pressure change is a predetermined value or less.

8. The method of claim 5, further comprising, after the discharging of the bubbles:

obtaining, by the controller, a rate of pressure change based on a temperature increase after the valve is opened; and closing, by the controller, the valve when the rate of pressure change exceeds a predetermined reference value after the valve is opened.

9. The method of claim 5, further comprising, after the discharging of the bubbles:

closing, by the controller, the valve when time that has been lapsed after the valve is opened exceeds a predetermined opening time.

10. The method of claim 9, wherein the opening time is in inverse proportion to the rate of pressure change.

* * * * *